US009994967B2

(12) United States Patent
Chen et al.

(10) Patent No.: US 9,994,967 B2
(45) Date of Patent: Jun. 12, 2018

(54) COPPER FILM WITH LARGE GRAINS, COPPER CLAD LAMINATE HAVING THE SAME AND MANUFACTURING METHOD OF COPPER CLAD LAMINATE

(71) Applicant: NATIONAL CHAIO TUNG UNIVERSITY, Hsinchu (TW)

(72) Inventors: Chih Chen, Hsinchu (TW); Chia-Ling Lu, Tainan (TW)

(73) Assignee: NATIONAL CHIAO TUNG UNIVERSITY, Hsinchu (TW)

( * ) Notice: Subject to any disclaimer, the term of this patent is extended or adjusted under 35 U.S.C. 154(b) by 93 days.

(21) Appl. No.: 14/948,708

(22) Filed: Nov. 23, 2015

(65) Prior Publication Data

US 2016/0168746 A1 Jun. 16, 2016

(30) Foreign Application Priority Data

Dec. 11, 2014 (TW) ..... 103143343 A

(51) Int. Cl.

| | |
|---|---|
| ***B32B 15/20*** | (2006.01) |
| ***C25D 5/50*** | (2006.01) |
| ***C22C 9/00*** | (2006.01) |
| ***C23C 28/02*** | (2006.01) |
| ***C23C 28/00*** | (2006.01) |
| *C25D 7/12* | (2006.01) |
| *C25D 3/38* | (2006.01) |
| *C25D 5/04* | (2006.01) |
| *C25D 5/18* | (2006.01) |

(52) U.S. Cl.

CPC ..... *C25D 5/50* (2013.01); *C22C 9/00* (2013.01); *C23C 28/021* (2013.01); *C23C 28/023* (2013.01); *C23C 28/42* (2013.01); *C25D 3/38* (2013.01); *C25D 5/04* (2013.01); *C25D 5/18* (2013.01); *C25D 7/123* (2013.01); *Y10T 428/1291* (2015.01); *Y10T 428/12431* (2015.01); *Y10T 428/12438* (2015.01); *Y10T 428/12806* (2015.01); *Y10T 428/12903* (2015.01)

(58) Field of Classification Search

None

See application file for complete search history.

(56) References Cited

U.S. PATENT DOCUMENTS

2010/0320577 A1* 12/2010 Pagaila ..... H01L 21/565 257/659
2012/0134049 A1* 5/2012 Maeda ..... G11B 5/82 360/110
2014/0162084 A1* 6/2014 Kammuri ..... B32B 15/08 428/606

OTHER PUBLICATIONS

Lu et al., "Extremely anisotropic single-crystal growth in nanotwinned copper", Oct. 2014, NPG Asia Materials, vol. 6, e135, pp. 1-8.*

* cited by examiner

*Primary Examiner* — Seth Dumbris

(74) *Attorney, Agent, or Firm* — Muncy, Geissler, Olds & Lowe, P.C.

(57) ABSTRACT

The present invention provides a copper film with large grains, where, at least one surface, more than 50% area of the copper film is [100]-oriented grains, and the average size of [100]-oriented grains is more than 150 μm. The grains on the copper film have large grain sizes and high preferred orientation, so that the copper film is provided with excellent properties such as flexibility, stability and electro-migration resistance. A copper foil laminate with the above-mentioned copper film is also herein provided.

16 Claims, 3 Drawing Sheets
(2 of 3 Drawing Sheet(s) Filed in Color)

COPPER FILM WITH LARGE GRAINS, COPPER CLAD LAMINATE HAVING THE SAME AND MANUFACTURING METHOD OF COPPER CLAD LAMINATE

BACKGROUND OF THE INVENTION

1. Field of the Invention

The present invention relates to a copper film, a copper clad laminate having the same and a manufacturing method of the copper clad laminate, and particularly to a copper film with large grains, a copper clad laminate having the same and a manufacturing method of the copper clad laminate.

2. Description of the Prior Art

With the evolution of science and technology, the demands for electronic products have been put on lightweight, thin-shape, small size and flexibility, which is the market trend. In related processes, a lot of copper materials are often used as conductors. In order to meet the market demands, a technology of manufacturing a flexible copper clad laminate, which is lightweight and thin-shaped and has excellent ductility and flexibility, has become the focus of current research.

However, in the conventional method for manufacturing a flexible copper clad laminate, although the rolled copper foil may have better flexibility, it can not be used to manufacture a very thin copper foil due to its thickness and manufacturing cost thereof is higher as well, which does not conform to the development trend of nowadays. On the other hand, although the electroplating copper foil may be manufactured thinner, it is formed by the electrolytic method and the microstructure for the grains of the copper foil has a vertical column shape. When it is bended, cracks may arise to induce a breaking, so it has poor flexibility. Therefore, it is needed to develop a method for manufacturing a copper clad laminate having excellent ductility and thin-shape and being low cost.

SUMMARY OF THE INVENTION

The present invention is directed to provide a copper film with large grains, a copper clad laminate having the same and a manufacturing method of the copper clad laminate. The copper film provided according to the manufacturing method of the present invention may have its grains reform due to an annealing treatment, so that a size of the grains may increase when crystallized, and the grains may grow in a high preferred direction, i.e., along a crystal axis direction [100]. Thus, the copper film of the present invention may have better ductility, and when it is bended, the cracks generated by the grain boundaries may be small. Also, the copper film of the present invention may have excellent flexibility, excellent mechanical, photoelectric, thermal stability and electro-migration resistance, so the copper film of the present invention may be beneficial for the applications of manufacturing lightweight and thin-shaped electronic products.

According to one embodiment of the present invention, a copper film with large grains is provided, wherein a plurality of grains of more than 50% area of at least one surface of the copper film are grown along a crystal axis direction [100], and an average size of the plurality of grains is more than 150 μm.

According to another embodiment of the present invention, a copper clad laminate is provided, which comprises: a laminate; and the above-mentioned copper film with large grains disposed on the laminate.

According to yet another embodiment of the present invention, a manufacturing method of a copper clad laminate is provided, which comprises: growing copper grains on one surface of a laminate by electroplating to obtain a [111]-oriented nanotwinned copper film; and annealing the [111]-oriented nanotwinned copper film under a temperature of 200-500° C. to obtain a copper film with large grains, wherein more than 50% of a plurality of grains of at least one surface of the copper film are grown along a crystal axis direction [100].

The objectives, subject matters and properties of the present invention and the effects achieved by the present invention will become apparent from the following descriptions of the embodiments taken in conjunction with the accompanying drawings.

BRIEF DESCRIPTION OF THE DRAWINGS

The patent or application file contains at least one drawing executed in color. Copies of this patent or patent application publication with color drawing(s) will be provided by the Office upon request and payment of the necessary fee.

DESCRIPTION OF THE PREFERRED EMBODIMENT

The present invention will be described in more detail in the following preferred embodiments taken in conjunction with the accompanying drawings. It is noted that the experiment data disclosed in the following embodiments is for convenience to explain the subject matters of the present invention, and it can never limit any aspects that can be embodied.

In general, the grains inside a material and the organization thereof have very important influence on performance. When the size of the grains is larger and the grain boundaries are less, cracks generated by the grain boundaries may be greatly reduced when the material is bended, so that the material may have advantage of excellent flexibility. Thus, in one embodiment of the present invention, a copper film with large grains is provided, wherein a plurality of grains are grown at at least one surface of the copper film. The at least one surface represents an upper surface and/or a lower surface. A plurality of grains of more than 50% area of at least one surface of the copper film are grown along a crystal axis direction [100], preferably, a plurality of grains of more than 80% area of at least one surface of the copper film are grown along the crystal axis direction [100], and more preferably, a plurality of grains of more than 90% area of at least one surface of the copper film are grown along the crystal axis direction [100].

Figure 1:
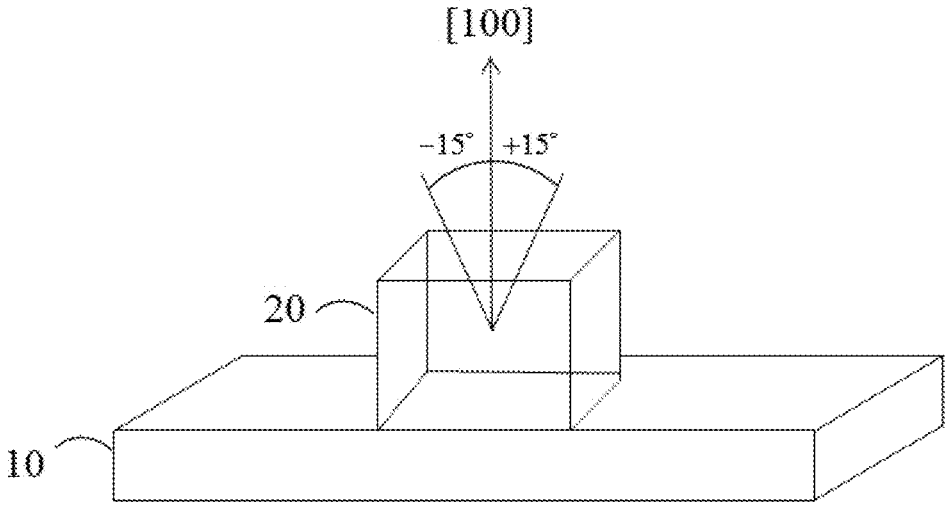
FIG. 1 is a schematic view of the grain grown direction according to the embodiment of the present invention.

It is noted that, in this embodiment, a crystal axis direction [100] is defined as a direction that is not deflected from the normal vector perpendicular to the copper film more than 15 degrees. As shown in FIG. 1, a crystal axis direction [100] that is not deflected from the normal vector perpendicular to the copper film toward the X axis more than 15 degrees is shown, but the present invention is not limited to this. In addition, a plurality of grains 20 are grown on one surface of a laminate 10. In FIG. 1, the grain 20 is for illustrative descriptions, but it is not intended to limit the relative size of the grain 20 and the laminate 10 in the present invention.

The copper film of the present invention may have a plurality of grains of large size, and an average size of the plurality of grains may be more than 150 μm. Preferably, an average size of the plurality of grains may be 400-700 μm. In addition, a thickness of the copper film 10 may be 0.1-200 μm. Preferably, a thickness of the copper film may be 2-50 μm. On the other hand, the elastic modulus of the copper film with large grains of the present invention is about 100-150 GPa, and preferably, is about 133.6 GPa. In addition, a hardness of the copper film with large grains of the present invention is about 1-2 GPa, and preferably, is about 1.68 GPa.

According to one embodiment of the present invention, a manufacturing method of a copper clad laminate is provided. The manufacturing method of a copper clad laminate of the present invention comprises: growing copper grains on one surface of a laminate by electroplating to obtain a nano nanotwinned copper film with a crystal axis direction [111] having a high density and regularly arranged grains, which may refer to the method described in the Taiwan patent No. 1432613 which is incorporated herein by reference.

In another embodiment of the present invention, the laminate for electroplating may be a homogeneous or heterogeneous laminate. When the laminate is a homogeneous laminate, copper film grains may be grown on the laminate directly by electroplating. When the laminate is a heterogeneous laminate, the laminate may be a silicon wafer or other appropriate base material, but is not limited to this. Prior to the electroplating step, the manufacturing method further comprises sputtering an adhesive layer on the laminate to grow copper film grains on the laminate by electroplating, and a material of the adhesive layer may comprise, but not limited to, titanium tungsten (TiW).

In another embodiment of the present invention, a copper seed layer is coated on the laminate or the adhesive layer to facilitate the growth of the grains. In one embodiment, the [111]-oriented copper of 200 nm thickness may be sputtered thereon to be served as a seed layer. In addition, after growing copper film grains on the laminate by electroplating, the copper foil may then be torn off to obtain a copper film with a single surface having [100]-oriented grains, thereby it may not be influenced by the annealing temperature. As a result, the limitation on the application of the printed circuit board industry due to the excessively high process temperature may be improved.

The objectives, subject matters and properties of the present invention and the effects achieved by the present invention will become apparent from the following descriptions of the embodiments taken in conjunction with the accompanying drawings, and the present invention may be implemented accordingly. However, the protective scope of the present invention is not limited to this.

Thereinafter, the manufacturing method of a copper clad laminate of the present invention is explained based on an illustrative embodiment, and related detailed process steps thereof may be found in NPG Asia Materials (2014) 6, e135, which is incorporated herein by reference. First, grains arranged in a crystal axis direction [111] are manufactured with the pulse electroplating method, which comprises the following steps: adding appropriate surfactant and 40 p.p.m hydrochloric acid (HCl) into the high purity copper sulfate ($CuSO_4$) solution to be served as the electrolyte, using 99.99% high purity copper plate as the cathode, using the silicon wafer as the laminate, sputtering titanium tungsten (TiW) of 200 nm thickness to be served as an adhesive layer, and then using OerlikonClusterLine 300 (OC Oerlikon Corporation AG, Pfaffikon, Switzerland) to sputter the [111]-oriented copper of 200 nm thickness on the adhesive layer to be served as a seed layer.

The silicon wafer may be cut into sheets of 3×1 $cm^2$ or 2×1 $cm^2$ and immersed in the electrolyte during pulse electroplating. The rotation speed for growing the nanotwinned copper is 600 r.p.m., and the current density is 50 mA $cm^{-2}$. The experimental period is $T_{on}$=0.02 s, and $T_{off}$=1.5 s. The deposition rate is 1.2 nm $s^{-1}$. Thereby, a nanotwinned copper film with a crystal axis direction [111] having a high density and regularly arranged grains is obtained.

Then, the nanotwinned copper film stacked along the crystal axis direction [111] is placed into a vacuum annealing furnace to be annealed under the temperature of 200-500° C. and recrystallized to obtain the copper film with large grains having the crystal axis direction [100]. Preferably, it may be annealed under the temperature of 250-450° C. for about 60 minutes. Here, the annealing treatment may be performed in a quartz tube of $5\times10^{-7}$ torr.

In this embodiment, a focused ion beam (FIB) is used to detect the grain shape of the copper film, the X-ray diffraction is used to analyze the texture of the copper film, and the electron back-scattered diffraction (EBSD) is used to detect the respective orientation of the grains of the copper film. Furthermore, the electron back-scattered diffraction analysis is performed with the EDAX/TSL system in conjunction with the JEOL 7001 F field-emission scanning electron microscope (JEOL Ltd., Tokyo, Japan) under 25 kV.

Figure 2A:
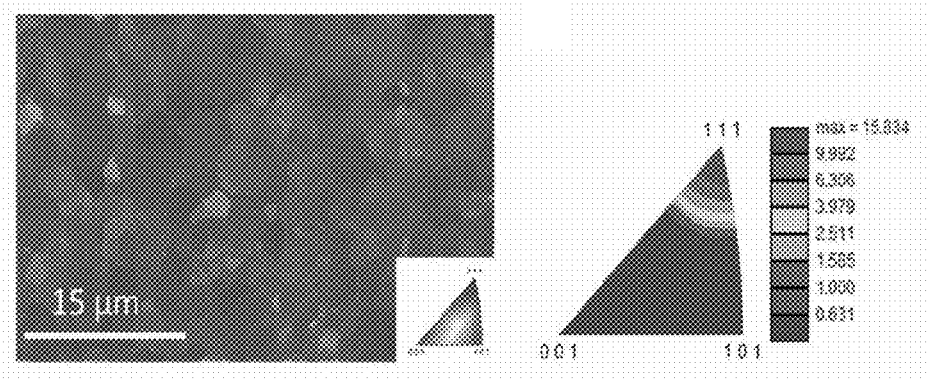
FIG. 2*a* and FIG. 3*a* are schematic views of the electron back-scattered diffraction (EBSD) analysis of the grains.
Figure 2B:
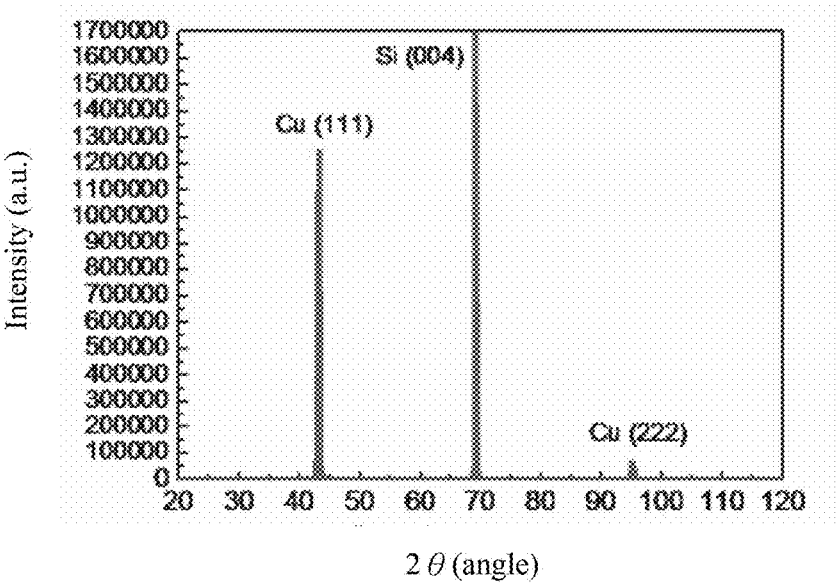
FIG. 2*b* is the result of the X-ray diffraction.
Figure 3A:
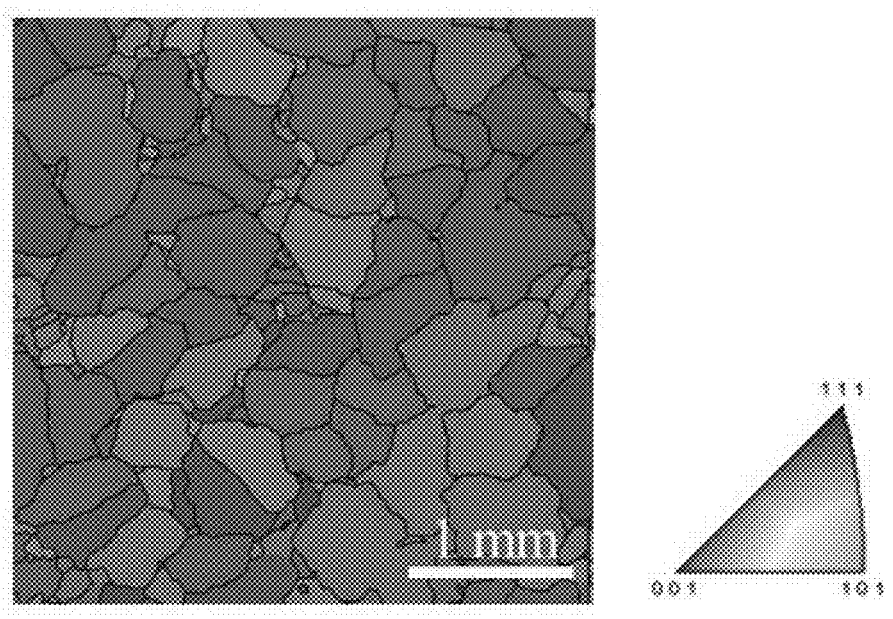

The results are shown in FIGS. 2*a*, 2*b* and 3*a*. Referring to FIG. 2*a*, with the above-mentioned electroplating method, surface grains grown in the crystal axis direction [111] may be obtained actually, and an average size of the grains is about 2.38±0.85 μm. As shown in FIG. 2*b*, according to the X-ray diffraction result, the copper film is grown to be highly [111]-oriented. Also, referring to FIG. 3*a*, with the above-mentioned annealing treatment, it can be found that, after the annealing treatment, the above-mentioned grains arranged in the crystal axis direction [111] may almost completely be transformed to be arranged in the crystal axis direction [100].

Figure 3B:
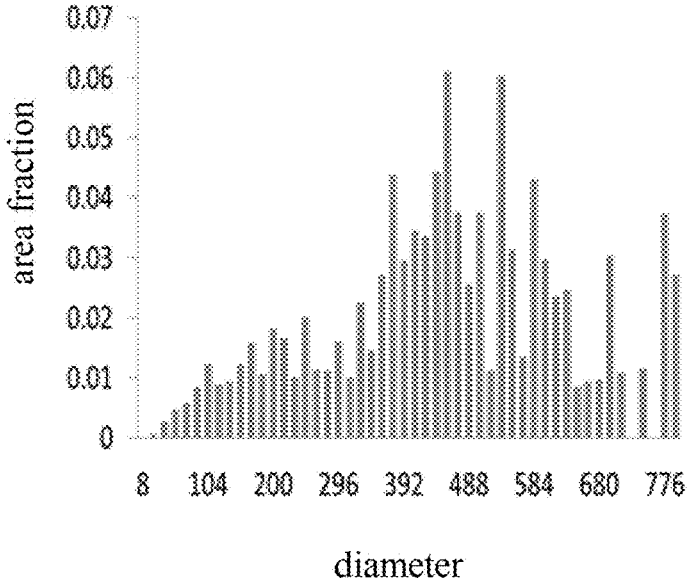
FIG. 3*b* is the diameter analysis of the grains according to the embodiment of the present invention.

Referring to FIG. 3*b*, the average size of the grains may be more than 150 μm. Preferably, the average size of the grains may be 400-700 μm. The resultant large grains may have a highly preferred direction. A plurality of grains of more than 50% area of at least one surface of the copper film are grown along the crystal axis direction [100], preferably, a plurality of grains of more than 80% area of at least one surface of the copper film are grown along the crystal axis direction [100], and more preferably, a plurality of grains of more than 90% area of at least one surface of the copper film are grown along the crystal axis direction [100].

To sum up the foregoing descriptions, according to the manufacturing method disclosed in the present invention, performing the annealing treatment after the traditional electroplating process may have the grains of the copper film/foil reform, and the recrystallization may have the grains have increased size and have a highly preferred direction. Thus, controlling the temperature and the time duration of the heat treatment may ensure that the grain size and the grain orientation of the copper foil may conform to the requirements. The copper film obtained according to the manufacturing method of the present invention may have grains having a large size and a highly preferred direction, and may have excellent flexibility, excellent mechanical, electrical, optical, and thermal stability and electro-migration resistance, so that it may be effectively applied in the development of related industries.

What is claimed is:

1. A copper film with large grains, wherein a plurality of grains of more than 50% area of at least one surface of the copper film are grown along a crystal axis direction [100], and an average size of the plurality of grains is more than 150 μm.

2. The copper film with large grains according to claim 1, wherein the plurality of grains of more than 80% area of the at least one surface of the copper film are grown along the crystal axis direction [100].

3. The copper film with large grains according to claim 1, wherein a thickness of the copper film is 0.1-200 μm.

4. The copper film with large grains according to claim 1, wherein a thickness of the copper film is 2-50 μm.

5. The copper film with large grains according to claim 1, wherein the average size of the plurality of grains is 400-700 μm.

6. The copper film with large grains according to claim 1, wherein the plurality of grains are grown at upper and lower surfaces of the copper film.

7. A copper clad laminate, comprising:

a laminate; and a copper film with large grains disposed on the laminate, wherein a plurality of grains of more than 50% area of at least one surface of the copper film are grown along a crystal axis direction [100], and an average size of the plurality of grains is more than 150 μm.

8. The copper foil laminate according to claim 7, wherein the plurality of grains of more than 80% area of the at least one surface of the copper film are grown along the crystal axis direction [100].

9. The copper foil laminate according to claim 7, wherein a thickness of the copper film is 0.1-200 μm.

10. The copper foil laminate according to claim 7, wherein a thickness of the copper film is 2-50 μm.

11. The copper foil laminate according to claim 7, wherein the average size of the plurality of grains is 400-700 μm.

12. The copper foil laminate according to claim 7, wherein the plurality of grains are grown at upper and lower surfaces of the copper film.

13. The copper clad laminate according to claim 7, further comprising:

an adhesive layer disposed between the copper film and the laminate.

14. The copper clad laminate according to claim 13, wherein a material of the adhesive layer is titanium tungsten (TiW).

15. The copper clad laminate according to claim 7, further comprising a copper seed layer disposed between the copper film and the laminate.

16. A manufacturing method of the copper clad laminate, comprising:

growing copper grains on one surface of a laminate by electroplating to obtain a [111]-oriented nanotwinned copper film; and annealing the [111]-oriented nanotwinned copper film under a temperature of 200-500° C. to obtain a copper film with a plurality of grains where an average size of the plurality of grains is more than 150 μm, wherein more than 50% of a plurality of grains of the copper film are grown along a crystal axis direction [100].

* * * * *